US008965223B2

(12) United States Patent
Isobe et al.

(10) Patent No.: US 8,965,223 B2
(45) Date of Patent: Feb. 24, 2015

(54) IMAGE FORMING APPARATUS HAVING A DEVELOPING DEVICE INCLUDING TWO ELECTRODE MEMBERS, AND FURTHER INCLUDING A DETECTION MECHANISM FOR DETECTING A CAPACITANCE BETWEEN THE TWO ELECTRODE MEMBERS

(71) Applicant: Canon Kabushiki Kaisha, Tokyo (JP)

(72) Inventors: Yuta Isobe, Kawasaki (JP); Motoki Adachi, Ashigarakami-gun (JP); Takuya Kitamura, Yokohama (JP); Hideo Kihara, Yokohama (JP); Kouki Yano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 13/711,476

(22) Filed: Dec. 11, 2012

(65) Prior Publication Data

US 2013/0163999 A1 Jun. 27, 2013

(30) Foreign Application Priority Data

Dec. 21, 2011 (JP) ..... 2011-280095

(51) Int. Cl.
*G03G 15/08* (2006.01)
*G03G 15/01* (2006.01)

(52) U.S. Cl.
CPC ..... *G03G 15/0877* (2013.01); *G03G 15/0173* (2013.01); *G03G 15/0848* (2013.01)
USPC ..... 399/12

(58) Field of Classification Search
CPC ..... G03G 15/0831; G03G 15/0856; G03G 15/086; G03G 15/0887; G03G 15/0877
See application file for complete search history.

(56) References Cited

U.S. PATENT DOCUMENTS

| | | | | |
|---|---|---|---|---|
| 5,987,269 | A * | 11/1999 | Allen et al. | 399/27 |
| 6,463,223 | B1 * | 10/2002 | Karakama et al. | 399/27 |
| 2011/0069978 | A1 * | 3/2011 | Yamamoto | 399/27 |

FOREIGN PATENT DOCUMENTS

| | | | |
|---|---|---|---|
| JP | 11-174775 | A | 7/1999 |
| JP | 2001-290356 | A | 10/2001 |
| JP | 2010-026497 | A | 2/2010 |

* cited by examiner

*Primary Examiner* — Clayton E Laballe
*Assistant Examiner* — Victor Verbitsky
(74) *Attorney, Agent, or Firm* — Canon U.S.A., Inc. IP Division

(57) ABSTRACT

An image forming apparatus includes a holding unit configured to change a developing device to first and second orientations. Whether a developer in the developing device is unevenly distributed in a longitudinal direction of the developing device is detected based on a capacitance C1 between first and second electrode members in the first orientation and a capacitance C2 between the first and second electrode members in the second orientation.

18 Claims, 7 Drawing Sheets

FIRST ORIENTATION
(DEVELOPABLE ORIENTATION)

SECOND ORIENTATION

IMAGE FORMING APPARATUS HAVING A DEVELOPING DEVICE INCLUDING TWO ELECTRODE MEMBERS, AND FURTHER INCLUDING A DETECTION MECHANISM FOR DETECTING A CAPACITANCE BETWEEN THE TWO ELECTRODE MEMBERS

CROSS REFERENCE TO RELATED APPLICATIONS

This application claims priority from Japanese Patent Application No. 2011-280095 filed Dec. 21, 2011, which is hereby incorporated by reference herein in its entirety.

BACKGROUND OF THE INVENTION

1. Field of the Invention

The present invention relates to an image forming apparatus which includes a developing device including two electrode members, and further includes a detection mechanism for detecting a capacitance between the two electrode members.

2. Description of the Related Art

An image forming apparatus such as an electrophotographic apparatus conventionally includes a developing device which contains toner, which is a developer. Some developing devices are shipped as preinstalled in the main body of an image forming apparatus. Others are packed and shipped by themselves, and a user mounts such developing devices on an image forming apparatus.

As image forming apparatuses have recently been reduced in size, developing devices have also been becoming smaller. Such small-sized image forming apparatuses and small-sized developing devices have become more likely, because of the smallness, to be transported in various orientations under excessive vibrations and stored in various orientations for long periods of time. The toner in even a new developing device is therefore not necessarily evenly distributed in the longitudinal direction of the developing device.

For example, using a developing device in which toner is unevenly distributed to one side in the longitudinal direction can cause image defects such as a white spot (image missing due to an insufficient density). In addition, a drive torque for rotating a developing roller (toner bearing member) and a stirring member of the developing device can become so high that a drive gear may break down. Japanese Patent Application Laid-Open No. 2001-290356 discusses a method for detecting the state of toner in the longitudinal direction of a developing device by arranging three or more electrodes inside the developing device.

According to the detection method discussed in Japanese Patent Application Laid-Open No. 2001-290356, a plurality of electrodes needs to be arranged in the toner container in addition to the toner bearing member. This increases the number of parts and complicates the configuration of the developing device.

SUMMARY OF THE INVENTION

The present invention is directed to an image forming apparatus capable of detecting uneven distribution of toner in a developing device with a simple configuration.

According to an aspect of the present invention, an image forming apparatus includes an image bearing member configured to bear an electrostatic latent image, a developing device configured to include first and second electrode members, store a developer, and develop the electrostatic latent image with the developer, a holding unit configured to hold the developing device and change an orientation of the developing device to first and second orientations, and a detection device configured to detect whether the developer in the developing device is unevenly distributed in a longitudinal direction of the developing device based on a capacitance C1 between the first and second electrode members in the first orientation and a capacitance C2 between the first and second electrode members in the second orientation.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 2A illustrates a state where the developing unit is held in a first orientation, and FIG. 2B illustrates a state where the developing unit is held in a second orientation.

FIG. 3A illustrates a state where the developing unit is held in the first orientation, and FIG. 3B illustrates a state where the developing unit is held in the second orientation.

DESCRIPTION OF THE EMBODIMENTS

Various exemplary embodiments, features, and aspects of the invention will be described in detail below with reference to the drawings.

The following exemplary embodiments describe the present invention byway of examples. The scope of an exemplary embodiment of the present invention is not limited to the dimensions, materials, shapes, and relative arrangement of the components described below unless otherwise specified.

Figure 1:
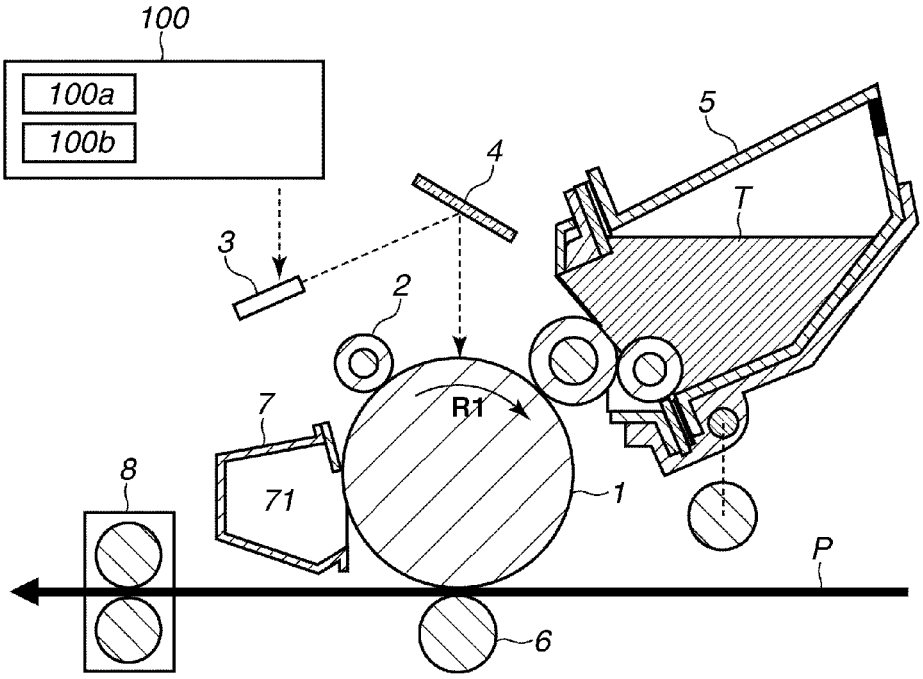
FIG. 1 is a schematic sectional view illustrating an example of an image forming apparatus according to an exemplary embodiment of the present invention.

FIG. 1 is a schematic diagram illustrating a general configuration of an image forming apparatus according to the present exemplary embodiment. This image forming apparatus is a monochromatic image forming apparatus using electrophotographic processes. The image forming apparatus forms an image on a sheet-like recording material P serving as a recording medium based on an electrical image signal input from a host apparatus to a controller unit (control unit: central processing unit (CPU)) 100. Examples of the host apparatus include an image reader (document image reading apparatus), a personal computer, and a facsimile machine.

The image forming apparatus includes a rotating drum type electrophotographic photosensitive member (hereinafter, referred to as a drum) 1 serving as an image bearing member which bears an electrostatic latent image on its surface. The image forming apparatus further includes a charging unit 2, an image exposure unit 3, a developing unit 5, a transfer unit 6, a drum cleaning unit 7, and a fixing unit 8 as process units that act on the drum 1.

The drum 1 is driven to rotate about a drum axis in a clockwise direction indicated by the arrow R1 at a predetermined speed. The charging unit 2 uniformly charges the surface of the drum 1 to a predetermined polarity (in the present exemplary embodiment, negative polarity) and potential. In the present exemplary embodiment, a contact charging roller is used as the charging unit 2.

The image exposure unit 3 forms an electrostatic latent image on the surface of the drum 1 via a mirror 4. In the present exemplary embodiment, a laser scanner unit is used as the image exposure unit 3. The developing unit 5 is a unit that visualizes the electrostatic latent image formed on the drum surface into a developer image (toner image). In the present exemplary embodiment, the developing unit 5 serving as a developing device is a reversal developing device of contact developing type which uses negatively charged nonmagnetic toner as a developer T.

The transfer unit 6 transfers the toner image visualized on the drum surface to a recording material P serving as a transfer material. A transfer roller is used as the transfer unit 6. The drum cleaning unit 7 removes transfer residual toner from the surface of the drum 1 after transfer. A cleaning blade is used as the drum cleaning unit 7.

The toner removed from the drum surface is stored in a cleaner container 71. The recording material P with the transferred toner image is guided into the fixing unit 8, and heated and pressed by a fixing nip portion. The toner image is thereby fixed to the recording material P.

Completing an image forming job on one sheet or a continuous plurality of sheets, the controller unit 100 puts the image forming apparatus into a standby state and waits for the input of a next image formation start signal. Specifically, the controller unit 100 stops driving the drum 1, the laser scanner unit 3, and the transfer unit 6.

Figure 2A:
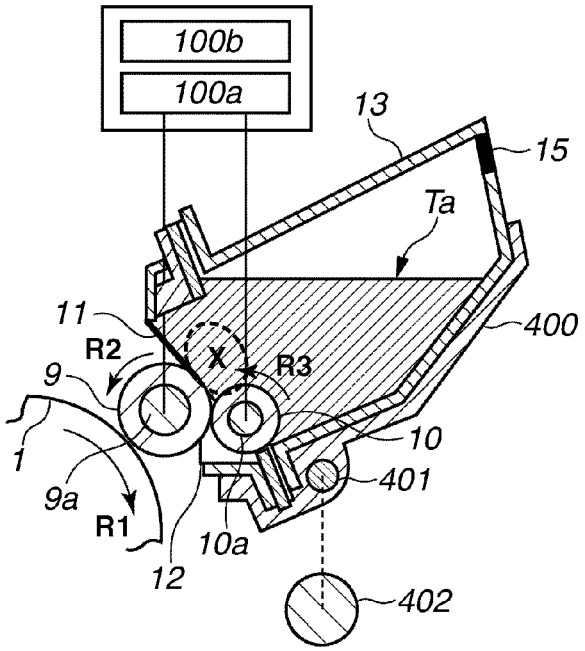
FIGS. 2A and 2B are schematic sectional views illustrating an example of a developing unit according to an exemplary embodiment of the present invention, and more specifically.

FIG. 2A is a schematic enlarged view of the developing unit 5 in an orientation where an electrostatic latent image formed on the drum surface can be developed (hereinafter, referred to as a first orientation). The developing unit 5 is detachably mounted on a mount 400 on the main body side of the image forming apparatus. In the present exemplary embodiment, the developing unit 5 in the first orientation is opposed to the drum 1 in an upright position with the top side of a toner container 13 upward and the bottom side downward. A developing roller 9 of such a developing unit 5 is in contact with the drum 1. The developing roller 9 in contact with the drum 1 develops an electrostatic latent image formed on the drum 1. In other words, the developing unit 5 uses a so-called contact developing method.

The developing unit 5 includes the toner container 13, the developing roller 9, and a supply roller 10. The toner container 13 serves as a toner storage chamber for storing the toner T. The developing roller 9 serves as a toner bearing member for developing the electrostatic latent image formed on the drum 1. The supply roller 10 serves as a toner supply member which contacts the developing roller 9 to supply the toner T.

The developing unit 5 further includes a regulation blade 11 and a leak prevention seal 12. The regulation blade 11 serves as a toner layer thickness regulation member for regulating the toner layer on the developing roller 9. The leak prevention seal 12 prevents leakage of the toner from a gap between the developing roller 9 and the toner container 13. The developing unit 5 further includes a storage unit 15 which stores whether the developing unit 5 is a new one. In the present exemplary embodiment, a noncontact nonvolatile memory is used as the storage unit 15.

The toner container 13 is an oblong container whose longitudinal direction is in the axial direction of the drum 1. The toner container 13 has an opening at its lower portion. The opening extends in the longitudinal direction of the toner container 13 and is opposed to the drum 1. The developing roller 9 is located in the opening and arranged in parallel to the longitudinal direction of the toner container 13. The developing roller 9 is rotatably supported by the toner container 13 via bearing members (not illustrated) that are attached to both longitudinal ends of the toner container 13, respectively.

The supply roller 10 is arranged inside the toner container 13 in parallel with the developing roller 9, on the other side of the developing roller 9 from where the developing roller 9 is opposed to the drum 1. The supply roller 10 is rotatably supported by the toner container 13 via bearings (not illustrated) that are attached to both longitudinal ends of the toner container 13, respectively.

In the present exemplary embodiment, the developing roller 9 has a diameter of ϕ13. The developing roller 9 includes a ϕ8 conductive core (first electrode member) 9*a* which is covered with a base layer of silicon rubber and further coated with acrylic urethane rubber. The developing roller 9 has a volume resistance of $10^4$ to $10^{12}$ Ω·m.

The supply roller 10 is a ϕ15 urethane sponge roller, including a ϕ6 conductive core (second electrode member) 10*a* covered with a urethane sponge layer 10*b* made of a foam layer of open-cell foam. The urethane sponge layer 10*b* has a volume resistance of around $10^4$ to $10^{12}$ Ω·m. In other words, the supply roller 10 includes an open-cell foam.

The distance (center distance) between the core 9*a* of the developing roller 9 and the core 10*a* of the supply roller 10 is 13 mm. The urethane sponge layer 10*b* (foam layer) of the supply roller 10 is pressed into the surface of the developing roller 9 by 1.0 mm.

The regulation blade 11 is a flexible member made of phosphor bronze or urethane rubber. The extremity of the regulation blade 11 slides over the developing roller 9 to form the toner applied to the developing roller 9 into a thin coating layer. The regulation blade 11 is arranged on the toner container 13 with its bottom fixed to the upper edge of the opening.

The leak prevention seal 12 is a flexible member whose top end is in contact with the developing roller 9 to cover a gap between a lower portion of the developing roller 9 and the toner container 13, thereby preventing leakage of the toner. The leak prevention seal 12 is arranged on the toner container 13 with its bottom fixed to the lower edge of the opening.

When performing image formation, a driving force and a developing bias are input to the developing unit 5 in the first orientation from a driving unit (not illustrated) and a power supply unit on the main body side of the image forming apparatus. The developing roller 9 is driven to rotate at a predetermined speed in a counterclockwise direction indicated by the arrow R2 in FIG. 2A. The rotational direction of the developing roller 9 at the drum contact portion is forward with respect to the rotational direction R1 of the drum 1.

The supply roller 10 which makes contact with the developing roller 9 to supply the toner to the developing roller 9 is driven to rotate at a predetermined speed in a counterclockwise direction indicated by the arrow R3. The rotational direction of the supply roller 10 at the drum contact portion is reverse (in a counter direction) with respect to the rotational direction R2 of the developing roller 9.

The rotating supply roller 10 applies the toner to the periphery of the rotating developing roller 9. The regulation blade 11 forms the applied toner into a thin coating film. The thin layer of the toner T is conveyed to a development position by the subsequent rotation of the developing roller 9, and applied to the surface of the drum 1.

A developing bias power supply unit applies a predetermined developing bias or direct-current (DC) voltage in the present exemplary embodiment to the developing roller 9. As a result, the thin layer of the toner on the periphery of the phase roller 9 is selectively transferred to the drum surface according to the electrostatic latent image on the drum surface. The electrostatic latent image is thereby developed as a toner image. The toner not consumed for the development of the electrostatic latent image is conveyed back into the toner container 13 by the subsequent rotation of the developing roller 9.

The supply roller 10 removes the toner from the surface of the developing roller 9 and applies the toner again to the surface of the developing roller 9. Such an operation is repeated to develop the electrostatic latent image on the drum surface.

In the prior example, the longitudinally uneven distribution of toner in a toner container is detected by using three or more electrodes in the toner container. On the other hand, according to the present exemplary embodiment, the detection is performed by using two electrodes.

The basic principle of the method for detecting uneven distribution of toner according to the present exemplary embodiment will be described. In the present exemplary embodiment, a conductive core 10*a* of the supply roller 10 is used as an electrode member arranged next to the developing roller 9. In the following description, a "capacitance" refers to the capacitance between the conductive core 9*a* of the developing roller 9 and the conductive core 10*a* of the supply roller 10.

To detect the capacitance, the bias power supply initially applies a toner uneven distribution detecting bias to the conductive core 10*a* of the supply roller 10. An alternating-current bias having a frequency of 5 kHz and a voltage of Vpp=200 V is used as the toner uneven distribution detecting bias.

The toner uneven distribution detecting bias induces a voltage on the conductive core 9*a* of the developing roller 9. The voltage is detected by a detector and rectified by a detection circuit, and whereby the capacitance is detected. In the following description, the capacitance is measured by using an inductance-capacitance-resistance (LCR) meter ZM2354 from NF Corporation.

First, a state where the toner T in the toner container 13 is longitudinally evenly distributed will be described. In the first orientation illustrated in FIG. 2A, the toner T in the toner container 13 deposits in the gravitational direction by the toner' own weight. Both the developing roller 9 and the opposed electrode member, i.e., the supply roller 10 lie below the toner surface Ta.

Here, in the first orientation, an area X is filled with a sufficient amount of toner T. The area X refers to an area that lies between the core 9*a* of the developing roller 9 and the core 10*a* of the supply roller 10 and has a large impact on the capacitance.

Figure 4:
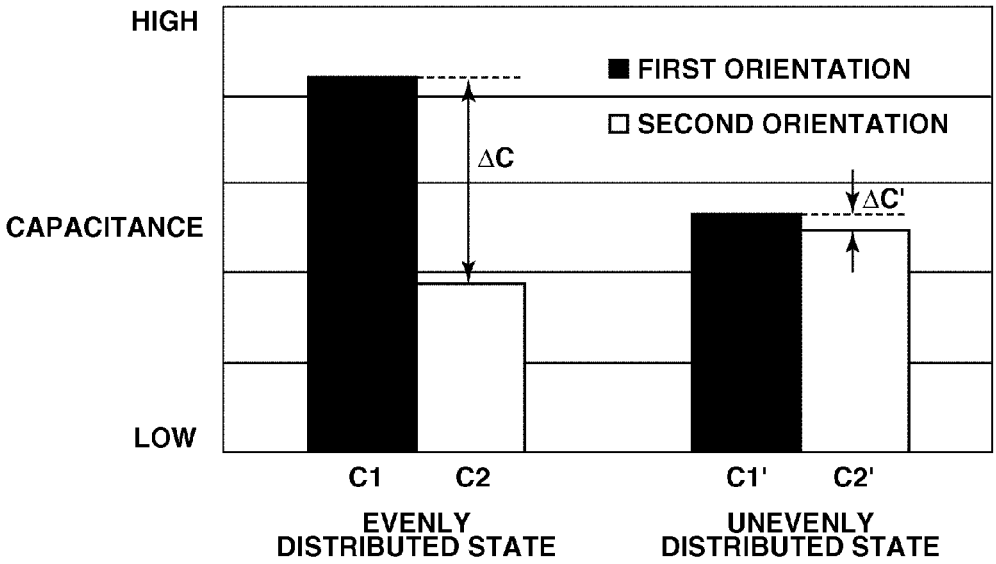
FIG. 4 is a graph illustrating states of uneven distribution of toner in a toner container and capacitances.

With the configuration of the present exemplary embodiment, the area X lies upstream of a nip portion (contact nip portion) between the developing roller 9 and the supply roller 10 in the rotational direction of the supply roller 10. The toner T has a dielectric constant approximately three times that of air. The greater the amount of toner T lying in the area X, the higher the capacitance. More specifically, when the developing unit 5 where the toner T in the toner container 13 is longitudinally evenly distributed is held in the first orientation, the capacitance C1 has a large value as illustrated in FIG. 4.

Figure 2B:
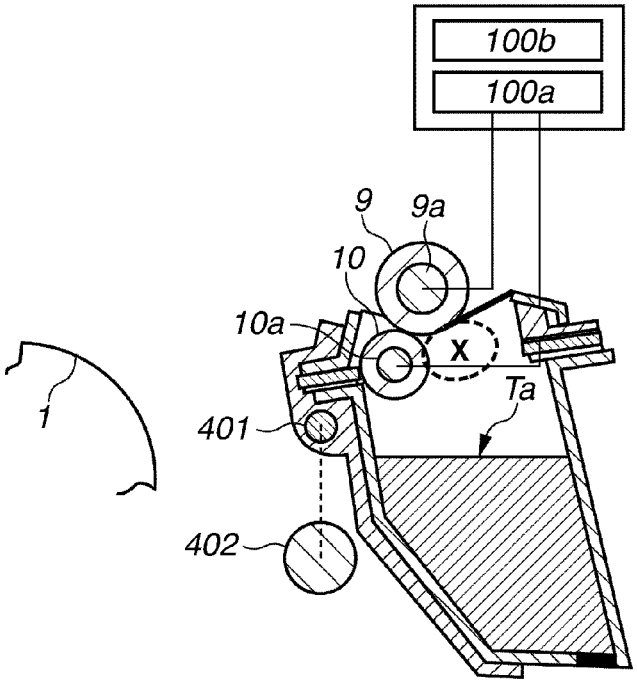

The mount 400 on which the developing unit 5 is mounted serves as a turning unit for changing the developing unit 5 to the first orientation illustrated in FIG. 2A and a second orientation illustrated in FIG. 2B. The turning unit is swung about a shaft 401 by a driving unit 402 under the control of the controller unit 100. Examples of the driving unit 402 include a gear mechanism using a forward reverse motor, an electromagnetic solenoid mechanism, and a rack and pinion mechanism.

The orientation illustrated in FIG. 2B is referred to as a second orientation. The developing unit 5 in the second orientation is in an inverted position with the top side of the toner container 13 downward and the bottom side upward. In such a second orientation, the toner T in the area X falls off into the toner container 13 by the toner's own weight.

As a result, no toner lies in the area X. When the developing unit 5 where the toner T in the toner container 13 is longitudinally evenly distributed is held in the second orientation, the capacitance C2 has a value smaller than C1 as illustrated in FIG. 4. The difference between the two capacitances, $\Delta C=|C1-C2|$, is calculated to have a value like illustrated in FIG. 4.

Figures 3A, 3B:
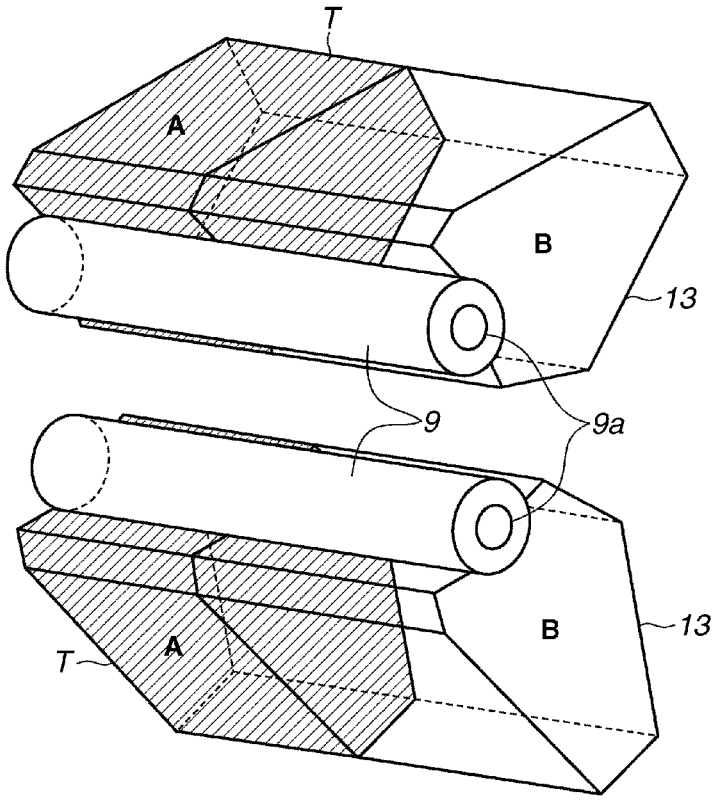
FIGS. 3A and 3B are schematic diagrams illustrating a developing unit in which toner is unevenly distributed to one side, and more specifically.

Next, a state where the toner T in the toner container 13 is unevenly distributed to one side in the longitudinal direction of the toner container 13 (i.e., the axial direction of the developing roller 9) will be described. FIG. 3A illustrates the developing unit 5 where the toner T is unevenly distributed to one side in the longitudinal direction. One longitudinal side is filled with the toner T.

Suppose that the developing unit 5 is held in the first orientation illustrated in FIG. 3A. In a portion A that is full of the toner T, the area X is filled with a sufficient amount of toner T. In a portion B that is not full of the toner T, the area X is not filled with the toner T. When the developing unit 5 where the toner T in the toner container 13 is unevenly distributed to one side in the longitudinal direction is held in the first orientation, the capacitance C1' has a value intermediate between C1 and C2 as illustrated in FIG. 4.

Next, the developing unit 5 is held in the second orientation illustrated in FIG. 3B. Some of the toner in the area X may move out of the area X, whereas the amount of toner in the area X will not vary much because the toner T in the toner container 13 is unevenly distributed to one side in the longitudinal direction.

When the developing unit 5 where the toner T in the toner container 13 is unevenly distributed is held in the second orientation, the capacitance C2' has a value similar to that of C1' as illustrated in FIG. 4. The difference between the two capacitances, $\Delta C'=|C1'-C2'|$, is calculated to have a value smaller than $\Delta C$.

As described above, when the toner T in the toner container 13 is longitudinally evenly distributed, the difference $\Delta C$ between the capacitance in the first orientation and the capacitance in the second orientation has a larger value. When the toner in the toner container 13 is unevenly distributed to one side in the longitudinal direction, the difference ΔC' between the capacitance in the first orientation and the capacitance in the second orientation becomes smaller than ΔC. This shows that a difference ΔC between the capacitance in the first orientation and the capacitance in the second orientation can be calculated to detect the state of uneven distribution of the toner T in the toner container 13.

Figure 5:
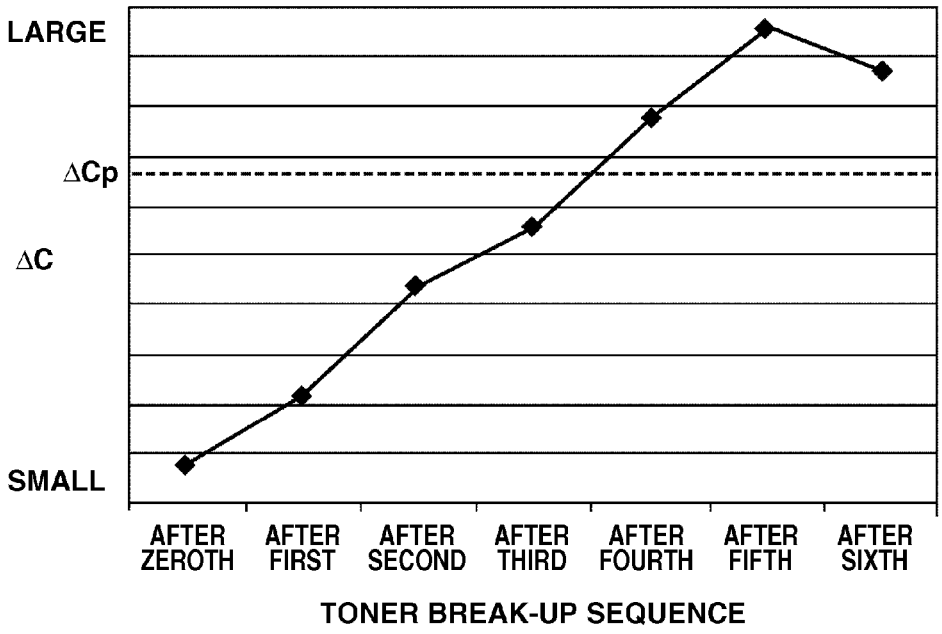
FIG. 5 is a graph illustrating states of uneven distribution of toner in a toner container and differences in capacitance.

Next, a method for determining the state of uneven distribution of the toner T in the toner container 13 based on a difference ΔC will be described based on the result of an experiment made by the present inventors (FIG. 5). The experiment was conducted by using a developing unit 5 which had been left for several days with the longitudinal direction of the developing unit 5 in the gravitational direction so that the toner T in the toner container 13 was unevenly distributed to one side in the longitudinal direction.

Initially, the difference ΔC of the developing unit 5 was measured. Then, an operation for breaking up the toner T in the toner container 13 to resolve the uneven distribution of the toner T (toner break-up sequence) was performed. In the present exemplary embodiment, the toner break-up sequence was performed by quickly swinging the mount 400 between the first orientation and the second orientation several times. The measurement of the difference ΔC and the toner break-up sequence were alternately repeated. FIG. 5 illustrates the result.

Before the toner break-up sequence (after zeroth) is performed, the difference ΔC of the developing unit 5 was measured to have a small value as illustrated in FIG. 5. The developing unit 5 in such a state can cause image defects such as a white spot on one side of an image.

As the toner break-up sequence was repeated, the difference ΔC increased gradually. After the fourth toner break-up sequence, the developing unit 5 caused no white-spot image defect. ΔCp will be defined as a threshold for determining the absence of uneven toner distribution. If the difference ΔC exceeds ΔCp, it is determined to be no uneven toner distribution. If the difference ΔC falls below ΔCp, it is determined to be uneven toner distribution.

Figure 6:
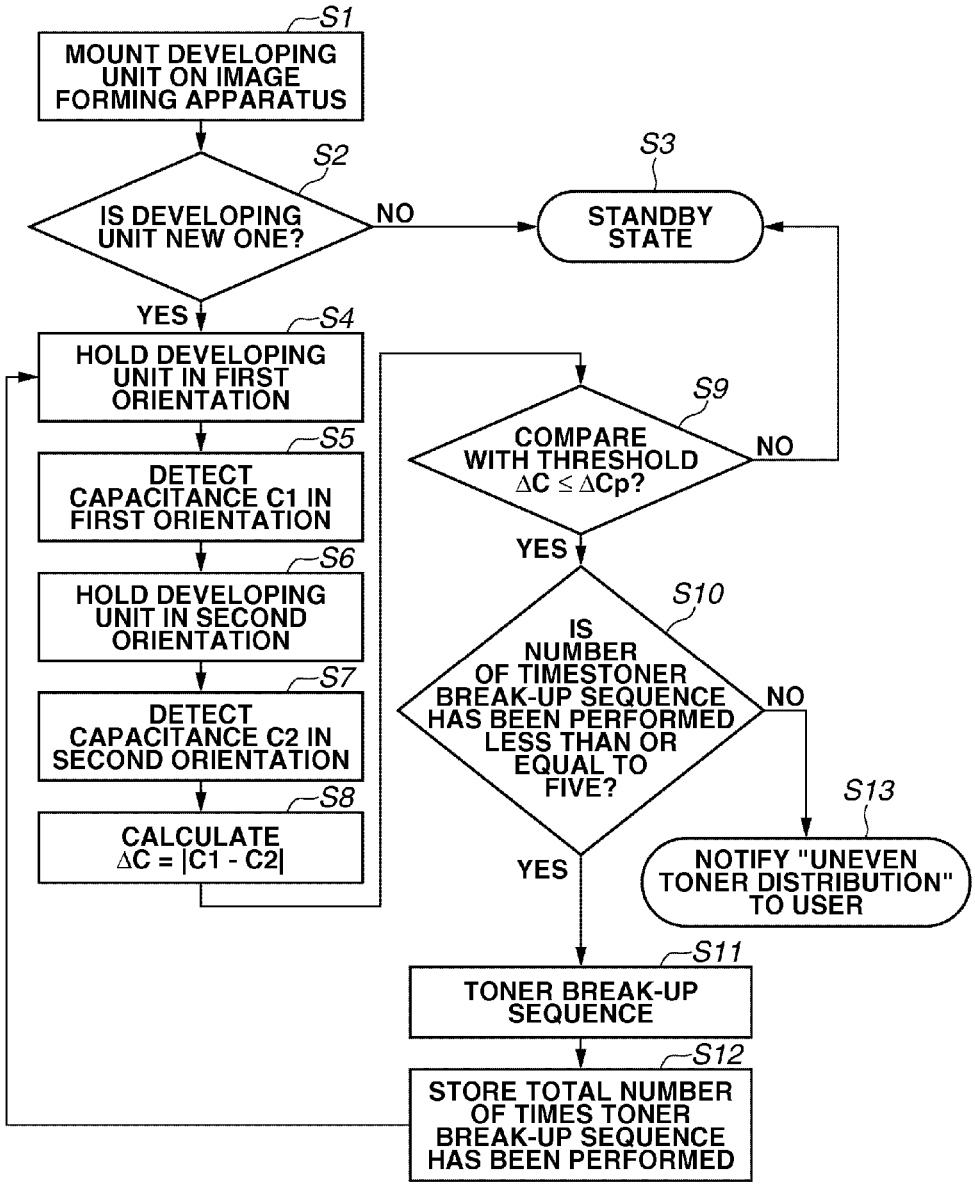
FIG. 6 is a flowchart for detecting an uneven distribution of toner according to a first exemplary embodiment.

Next, an operation when the developing unit 5 is mounted on the image forming apparatus will be described with reference to FIG. 6.

In step S1, the user mounts the developing unit 5 on the mount 400. In step S2, with the developing unit 5 mounted on the mount 400, the controller unit 100 accesses the memory 15 of the developing unit 5 and determines whether the developing unit 5 is a new one. If the developing unit 5 is not a new one (NO in step S2), then in step S3, the controller unit 100 enters a standby state. If the developing unit 5 is a new one (YES in step S2), then in step S4, the controller unit 100 controls the driving unit 402 to swing the developing unit 5 about the shaft 401 so that the developing unit 5 is held in the first orientation illustrated in FIG. 2A.

In step S5, an uneven distribution detection device 100*a* (uneven distribution detection unit) applies the toner uneven distribution detecting bias to the conductive core 10*a* of the supply roller 10 and detects the capacitance C1. In step S6, the controller unit 100 drives the driving unit 402 to perform a swing control so that the developing unit 5 is held in the second orientation illustrated in FIG. 2B.

In step S7, the uneven distribution detection device 100*a* detects the capacitance C2 like the first orientation. In step S8, the controller unit 100 calculates a difference between the detected capacitances C1 and C2, i.e., $\Delta C=|C1-C2|$.

In step S9, the controller unit 100 compares the difference ΔC with the threshold ΔCp. If ΔC is greater than ΔCp (NO in step S9), then in step S3, the controller unit 100 enters a standby state, determining that the toner T in the toner container 13 is longitudinally evenly distributed. If ΔC is smaller than or equal to ΔCp (YES in step S9), the controller unit 100 determines that the toner T in the toner container 13 is unevenly distributed to one side in the longitudinal direction.

If the toner is determined to be unevenly distributed (YES in step S9), then in step S10, the controller unit 100 determines the number of times the toner break-up sequence has been performed. If the number of times is less than or equal to a predetermined number (YES in step S10), then in step S11, the controller unit 100 performs the toner break-up sequence. In step S12, after the completion of the sequence, the controller unit 100 stores the total number of times the sequence has been performed. In step S4, the controller unit 100 makes the developing unit 5 held in the first orientation again, and performs the capacitance detection routine described above.

If such an operation is repeated and the toner T is still determined to be unevenly distributed when the number of times of the toner break-up sequence exceeds the predetermined number (NO in step S10), then in step S13, the controller unit 100 notifies a display unit 100*b* of the "uneven toner distribution" to instruct the user to dismount and shake the developing unit 5.

The foregoing number of times may be determined as appropriate depending on the configuration including the ease of break-up of the toner T and the driving speed of the mount 400. In the present exemplary embodiment, the predetermined number of times was set to five based on the result of the foregoing experiment.

As described above, in the present exemplary embodiment, the developing unit 5 is changed to the first orientation in which the toner T lies in the area between the cores 9*a* and 10*a* and the second orientation in which at least part of the toner T lying in the area between the cores 9*a* and 10*a* in the first orientation moves out of the area. Whether the toner T in the toner container 13 is unevenly distributed is detected based on a comparison between the capacitance C1 between the cores 9*a* and 10*a* in the first orientation and the capacitance C2 between the cores 9*a* and 10*b* in the second orientation. The uneven distribution of the toner T in the toner container 13 can thus be detected with a simple configuration.

In the present exemplary embodiment, the uneven distribution of the toner T is detected based on a difference between the capacitances C1 and C2. However, the uneven distribution of the toner T may be detected based on a ratio between the capacitances C1 and C2. For example, the toner T may be determined to be unevenly distributed and the toner break-up sequence may be performed if the ratio C2/C1 exceeds a threshold. The uneven distribution detection apparatus 100*a* can thus detect whether the toner T in the toner container 13 is unevenly distributed based on a comparison between the capacitances C1 and C2.

While the present exemplary embodiment performs the toner break-up sequence, a warning prompting the user to shake the developing unit 5 may be issued instead of the sequence. While the present exemplary embodiment employs a contact developing method, a noncontact developing method (jumping developing method) is also applicable.

Figure 7:
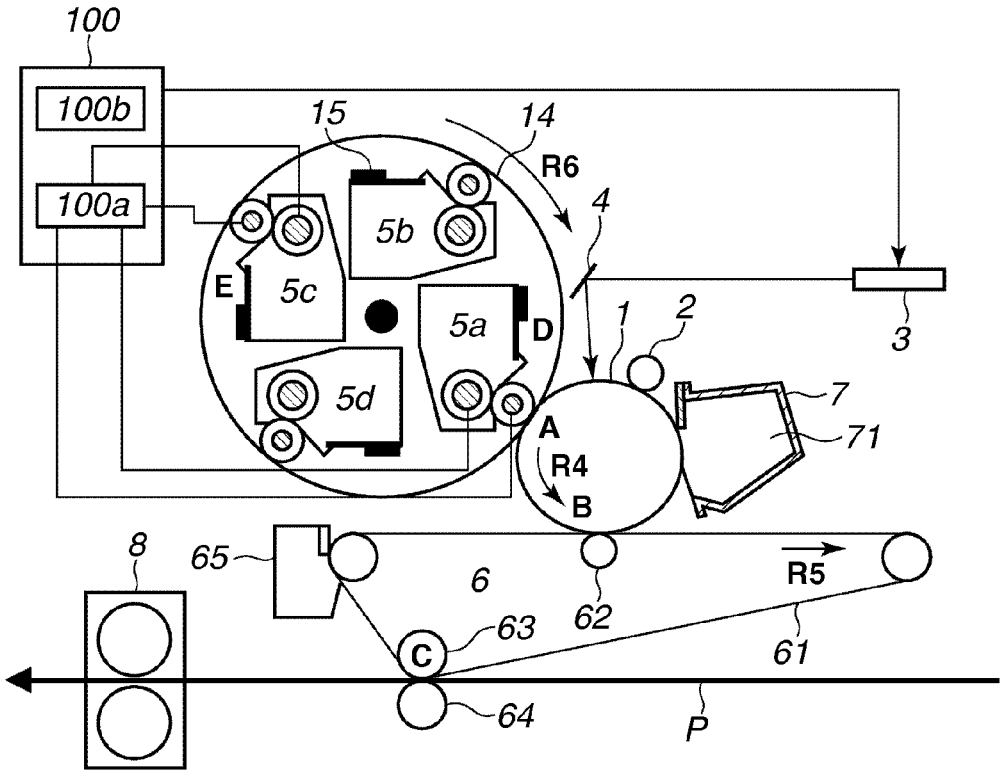
FIG. 7 is a schematic sectional view illustrating an example of an image forming apparatus according to a second exemplary embodiment.

FIG. 7 is a schematic diagram illustrating a general configuration of an image forming apparatus according to a second exemplary embodiment. This image forming apparatus is a four-color full color image forming apparatus using electrophotographic processes. The image processing apparatus includes a rotating drum type electrophotographic photosensitive member (hereinafter, referred to as a drum) 1. The image processing apparatus further includes a charging unit 2, an image exposure unit 3, developing units 5 (5*a*, 5*b*, 5*c*, and 5*d*), a transfer unit 6, a drum cleaning unit 7, and a fixing unit 8.

The image forming apparatus according to the second exemplary embodiment includes a plurality of developing units 5 serving as developing units. More specifically, the image forming apparatus includes first to fourth four developing units 5. A rotary 14 serving as a holding unit holds the plurality of developing units 5. The rotary 14 is rotatably supported and can rotate and move a desired developing unit 5 (for example, the developing unit 5*a*) to a development position A where the developing unit 5 is opposed to and makes contact with the photosensitive drum 1.

The image forming apparatus according to the second exemplary embodiment further includes a transfer belt 61 serving as an intermediate transfer member. The transfer belt 61 is rotatably stretched around a plurality of rollers. The photosensitive drum 1 and the transfer belt 61 are pressed against and make contact with each other in a primary transfer position B, where a primary transfer roller 62 is arranged to sandwich the transfer belt 61 between the photosensitive drum 1 and the primary transfer roller 62.

A toner image formed in the development position A is transferred to the transfer belt 61 in the primary transfer position B. A recording material P and the transfer belt 61 are pressed against and make contact with each other in a secondary transfer position C, where a secondary transfer counter roller 63 and a secondary transfer roller 64 are arranged. The transfer belt 61 is stretched around the secondary transfer counter roller 63. The secondary transfer roller 64 is configured to be able to come into contact with and draw away from the transfer belt 61.

A cleaning device 65 is arranged downstream of the secondary transfer position C in the moving direction of the transfer belt 61. The cleaning device 65 is arranged in contact with the transfer belt 61 so that a blade of the cleaning device 65 can scrape toner off the transfer belt 61.

Next, an operation for forming a four-color full color image will be described. The photosensitive drum 1 is driven to rotate in the direction of the arrow R4 at a predetermined speed. The charging unit 2 uniformly charges the drum surface to a predetermined potential.

The image exposure unit 3 and a reflection mirror 4 form an electrostatic latent image on the drum surface corresponding to an image signals of each color. A developing unit 5 develops the formed electrostatic latent image in the development position A to form a toner image.

The developing unit 5 to be located in the development position A is determined according to the color-specific image signals. The rotary 14 is rotated in the direction of the arrow R6 in advance to locate a developing unit 5 of a desired color in the development position A.

Toner images are develop in fixed color order. In the present exemplary embodiment, toner images are formed in the order of yellow, magenta cyan, and black. The toner image formed on the drum 1 is transferred to the transfer belt 61 in the primary transfer position B. The transfer belt 61 is driven in the direction arrow R5. Formed toner images are successively superposed on previously transferred ones to form a full color toner image on the intermediate transfer belt 61.

The secondary transfer roller 64 and the cleaning device 65 are separated from the transfer belt 61 until the formation of a full color toner image is formed, and put into contact with the transfer belt 61 after the formation.

A recording material P is conveyed in synchronization with the timing at which the formed full color toner image reaches the secondary transfer position C. The secondary transfer roller 64 and the secondary transfer counter roller 63 sandwich the recording material P and the transfer belt 61 together to transfer the full color toner image to the recording material P.

The recording material P with the transferred full color toner image is conveyed to the fixing unit 8. The fixing unit 8 applies heat and pressure to the full color toner image on the recording material P, and whereby the full color toner image is fixed to the recording material P as a final image.

Next, a method for detecting uneven distribution of toner according to the present exemplary embodiment will be described with reference to FIG. 7. The orientation of a developing unit 5 in the position D will be referred to as a first orientation. The orientation of a developing unit 5 in the position E will be referred to as a second orientation.

The following description deals with the method for detecting the uneven distribution of the toner in the developing unit 5*a*. The method can be similarly performed on the not-mentioned developing units (5*b*, 5*c*, and 5*d*). The uneven distribution of the toner in the developing unit 5*a* is detected by an uneven toner distribution detection device 100*a*. When the developing unit 5*a* is mounted on the image forming apparatus, the controller unit 100 accesses the memory 15 of the developing unit 5*a* and determines whether the developing unit 5*a* is a new one.

If the developing unit 5*a* is determined to be a new one, the developing unit 5*a* is held in the position D of FIG. 7, i.e., in the first orientation. In such a state, the uneven toner distribution detection device 100*a* changes a switch (not illustrated) to make contact only with the developing unit 5*a* in the position D.

The uneven toner distribution detection device 100*a* performs capacitance detection on the developing unit 5*a* in the first orientation to detect a capacitance C1*y*. The rotary 14 is then driven to rotate and hold the developing unit 5*a* in the position E in the second orientation. The uneven toner distribution detection device 100 similarly changes a switch to make contact with only the developing unit 5*a* in the position E.

The uneven toner distribution detection device 100*a* performs capacitance detection on the developing unit 5*a* in the second orientation to detect a capacitance C2*y*. The controller unit 100 calculates a difference between the detected C1*y* and C2*y*, and compares the difference with a threshold ΔCp to determine whether the toner in the toner container is longitudinally unevenly distributed.

If the toner is determined to be unevenly distributed, the controller unit 100 performs a toner break-up sequence. For the toner break-up sequence, for example, an operation for rotating the rotary by 90° and stopping the rotary 14 is performed for a single rotation of the rotary 14. The toner break-up sequence is not limited to such an operation. The rotary 14 may be rotated back and forth. The rotary 14 may be rotated by 30° and stopped. Any operation may be performed as long as the toner in the toner container spreads out in the longitudinal direction.

After the completion of the toner break-up sequence, the uneven toner distribution detection device 100*a* detects the uneven distribution of the toner again. The toner break-up sequence and the detection of the uneven distribution of the toner are then alternately repeated. If the toner is not determined to be evenly distributed even after the toner break-up sequence is performed several time, a warning like "the toner is unevenly distributed" may be displayed on the display unit 100*b* of the operation unit to prompt the user to dismount and shake the developing unit 5*a*.

In the present exemplary embodiment, the uneven distribution of the toner is detected based on a difference between the capacitances C1*y* and C2*y*. However, the uneven distribution of the toner may be detected based on a ratio between the capacitances C1*y* and C2*y*. For example, the toner may be determined to be "unevenly distributed" and the toner break-up sequence may be performed if the ratio C2*y*/C1*y* exceeds a threshold.

The uneven toner distribution detection device 100*a* can thus detect whether the toner in the toner container is unevenly distributed based on a comparison between the capacitances C1*y* and C2*y*.

While the present exemplary embodiment employs a contact developing method, a noncontact developing method (jumping developing method) is also applicable.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An image forming apparatus comprising:

an image bearing member configured to bear an electrostatic latent image;

a developing device configured to include first and second electrode members, store a developer, and develop the electrostatic latent image with the developer;

a holding unit configured to hold the developing device and change an orientation of the developing device to first and second orientations; and a detection device configured to detect whether the developer in the developing device is unevenly distributed in a longitudinal direction of the developing device based on a capacitance C1 between the first and second electrode members in the first orientation and a capacitance C2 between the first and second electrode members in the second orientation.

2. The image forming apparatus according to claim 1, further comprising a determination unit configured to determine whether the developing device is a new one, wherein the detection device is configured to perform the detection if the determination unit determines that the developing device is a new one.

3. The image forming apparatus according to claim 1, further comprising an additional developing device, wherein the holding unit is configured to hold the plurality of developing devices and rotate to change the orientation of each of the developing devices to the first and second orientations.

4. The image forming apparatus according to claim 1, wherein the holding unit is configured, if the detection device detects that the developer in the developing device is unevenly distributed in the longitudinal direction of the developing device, to perform an operation for resolving the uneven distribution.

5. The image forming apparatus according to claim 1, wherein the image forming apparatus is configured, if the detection device detects that the developer in the developing device is unevenly distributed in the longitudinal direction of the developing device, issue a warning prompting a user to shake the developing device.

6. The image forming apparatus according to claim 1, wherein the developing device includes a developer bearing member configured to bear the developer and develop the electrostatic latent image, and wherein the first electrode member is included in the developer bearing member.

7. The image forming apparatus according to claim 6, wherein the developing device includes a developer supply member configured to supply the developer to the developer bearing member, and wherein the second electrode member is a core of the developer supply member.

8. The image forming apparatus according to claim 1, wherein the detection device is configured to perform the detection based on a difference between the capacitances C1 and C2.

9. The image forming apparatus according to claim 1, wherein the detection device is configured to perform the detection based on a ratio between the capacitances C1 and C2.

10. An image forming apparatus to which a developing device is detachably attachable, the developing device being configured to include first and second electrode members, store a developer, and develop an electrostatic latent image formed on an image bearing member with the developer, the image forming apparatus comprising:

a holding unit configured to hold the developing device and change an orientation of the developing device to first and second orientations; and a detection device configured to detect whether the developer in the developing device is unevenly distributed in a longitudinal direction of the developing device based on a capacitance C1 between the first and second electrode members in the first orientation and a capacitance C2 between the first and second electrode members in the second orientation.

11. The image forming apparatus according to claim 10, further comprising a determination unit configured to determine whether the developing device is a new one, and wherein the detection device is configured to perform the detection if the determination unit determines that the development device is a new one.

12. The image forming apparatus according to claim 10, wherein the holding unit is configured to hold a plurality of developing devices and rotate to change each of the developing devices to the first and second orientations.

13. The image forming apparatus according to claim 10, wherein the holding unit is configured, if the detection device detects that the developer in the developing device is unevenly distributed in the longitudinal of the developing device, to perform an operation for resolving the uneven distribution.

14. The image forming apparatus according to claim 10, wherein the image forming apparatus is configured, if the detection device detects that the developer in the developing device is unevenly distributed in the longitudinal direction of the developing device, to issue a warning prompting a user to shake the developing device.

15. The image forming apparatus according to claim 10, wherein the image forming apparatus includes a developer bearing member configured to bear the developer and develop the electrostatic latent image, and wherein the first electrode member is included in the developer bearing member.

16. The image forming apparatus according to claim 15, wherein the developing device includes a developer supply member configured to supply the developer to the developer bearing member, and wherein the second electrode member is a core of the developer supply member.

17. The image forming apparatus according to claim 10, wherein the detection device is configured to perform the detection based on a difference between the capacitances C1 and C2.

18. The image forming apparatus according to claim 10, wherein the detection device is configured to perform the detection based on a ratio between the capacitances C1 and C2.

* * * * *